United States Patent [19]

Gall

[11] 4,001,852

[45] Jan. 4, 1977

[54] ROTATING AUGER ARRANGEMENT FOR PUMPING PROCESSING FLUID THROUGH A FILM DEVELOPING CONTAINER

[76] Inventor: Kurt Gall, Welfenstr. 22, Suttgart-Birkach, Germany, 7000

[22] Filed: Dec. 9, 1975

[21] Appl. No.: 639,213

[30] Foreign Application Priority Data

Dec. 10, 1974 Germany ..... 2458276

[52] U.S. Cl. ..... 354/313; 354/324; 354/329

[51] Int. Cl.[2] ..... G03D 17/00

[58] Field of Search ..... 354/311, 313, 315, 316, 354/324, 331, 337, 329

[56] References Cited

UNITED STATES PATENTS

| | | | |
|---|---|---|---|
| 2,862,432 | 12/1958 | Schiller | 354/313 |
| 3,517,600 | 6/1970 | Woollacott | 354/328 X |
| 3,596,585 | 8/1971 | Lewandowski | 354/337 X |
| 3,886,575 | 5/1975 | Gall | 354/311 |

*Primary Examiner*—R. L. Moses
*Attorney, Agent, or Firm*—Karl F. Ross; Herbert Dubno

[57] ABSTRACT

Film is mounted in a holder in a cassette whose top is closed by a cover having a throughgoing hole provided with a light gate and whose bottom has a similar hole over which is provided an auger carried on an upright shaft passing through the cover of the container. This container is immersed in a vessel containing a bath of treatment liquid with a motor mounted on the cover turning the auger so as rapidly to suck in a quantity of the treatment liquid, circulate it through the container, and force it out the top. During treatment the motor operates to maintain this circulation through the container. After the necessary treatment time has elapsed the motor is reversed to pump out the interior of the container and the container may then be set, after another motor reversal, in another bath for further treatment of the film in the container.

12 Claims, 3 Drawing Figures

ROTATING AUGER ARRANGEMENT FOR PUMPING PROCESSING FLUID THROUGH A FILM DEVELOPING CONTAINER

FIELD OF THE INVENTION

The present invention relates to an apparatus for developing film. More particularly this invention concerns a cassette arrangement allowing film to be developed in illuminated surroundings.

BACKGROUND OF THE INVENTION

It is known to develop a film by mounting it in a holder within a closable cassete provided with at least one hole having a so-called light gate that permits a fluid to enter or leave the cassette without letting light pass. The holder carrying the film is secured in this cassette in a darkroom and thereafter the closed cassette may be immersed in the various film-treatment baths in an illuminated area. Such an arrangement is frequently used by amateurs or small-capacity photo labs.

Usually the cassette or container in which the film is held is forcibly immersed by the operator in the treatment bath and held there until it slowly fills up with the treatment liquid. Thereafter the cassette is agitated to bring the liquid into contact with the film, and at the end of the treatment time the entire cassette is slowly raised out of the bath. The immersion and extraction time is usually relatively long because the light gate prevents rapid fluid passage through the holes into the cassette.

Since on to three liters of fluid are generally needed for the treatment, the time necessary for this fluid to flow into or out of the cassette is long. In addition it is necessary that the fluid be circulated to some extent within the cassette, usually by means of a paddle-type mixing device within the cassette or simply by jiggling or vibrating the cassette manually, in order to achieve even results. Even with the best of such arrangements, however, the film develops irregularly in many instances since it is impossible to obtain a uniform treatment of the entire exposed film surface.

The extended time it takes the cassette to fill and empty also makes it difficult exactly to control how long the film is exposed to the particular treatment liquid. The film or film portion lowest in the cassette is invariably treated substantially longer than the rest of the film, as the bottom of the cassette is the first part to fill up and the last part to empty.

OBJECTS OF THE INVENTION

It is therefore an object of the present invention to provide an improved apparatus for treating a photographic film with a liquid.

Another object is an improved cassette-type treating apparatus which overcomes the above-given disadvantages.

Yet another object is to provide a film-developing cassette which can be filled up and emptied very rapidly, and wherein the treatment liquid is circulated evenly over the entire film surface.

SUMMARY OF THE INVENTION

These objects are attained according to the present invention in an arrangement having an outer vessel for holding a bath of film-treatment liquid, a container receivable within this vessel and having a removable cap each formed with at least one throughgoing hole for passage through the container of the film-treatment liquid. Means is provided in the container for holding the film between the base and the cap, and a rotatable shaft extending upwardly in the container from the base to the cap carries an auger secured to the shaft adjacent the base and having a pitch greater than 45°. Means is provided for preventing light from entering the container through the holes and falling on the film. In this arrangement the auger can be rotated in order to suck the liquid rapidly into the cassette through the hole in the bottom, and can be reverse rotated in order rapidly to pump out the container after the treatment operation.

In accordance with the present invention the auger is provided directly over the hole in the base of the cassette and therefore constitutes the light gate at this hole, and a motor is provided on the cassette cap for rotating this auger. After the cassette is filled continued rotation of the auger serves to draw the treatment fluid in through the bottom and force it out through the top, circulating it evenly through the cassette over the exposed film therein. The vessel containing the cassette need only be slightly larger than the cassette in order to provide a return path for the treatment liquid down around the outside of the container or cassette.

A second auger in accordance with this invention may be provided directly under the hole in the top of the cassette. Both of these augers have the same steep pitch and two interleaved turns. The film is held on the shaft between the two augers and can thus be effectively contacted with the treatment liquid.

In accordance with further features of this invention the container is generally cylindrical as is the vessel in which it is adapted to sit. Both are formed of a chemical-resistent synthetic-resin material and the cap is screwed on over the container. In the darkroom strip-type film is loaded onto spool holders and these spools are slipped over the upright shaft of the container. The upper auger is fitted in place, and the cap is screwed on. Thereafter the area may be illuminated and the subsequent treatment of the film can be carried on in a fully lit environment.

In accordance with this invention several such vessels may be provided each with a respective and different treatment liquid. All of these vessels may sit in a common recepticle having a liquid such as water in it which is maintained at the exact temperature necessary for the film treatment. The cassette is then moved from one vessel into the other for the necessary treatment steps, the motor being reverse rotated only as the cassette is being withdrawn from one bath and before immersion in the next one.

In order to treat other than strip-type film it is possible to form the container in accordance with this invention of rectangular cross section and provide a plurality of such auger arrangements to fill and empty the cassette and circulate the film-treatment liquid therein. Such an arrangement may be provided with clips or holders for flat negatives, negative plates, or x-ray plates. In such an arrangement each of the augers is received in a respective well in the bottom of the container and the base holes of the container are formed at the bottoms of these wells.

The hole in the upper part of the cassette may also be constituted around the entire edge of this cassette, by means of inverleaved baffles formed on the cover and on the upper edge of the container. A gap between the baffles and notches cut in the top of the upper edge allow fluid to pass out of the cassette while not permitting light to enter.

SPECIFIC DESCRIPTION

Figure 1:
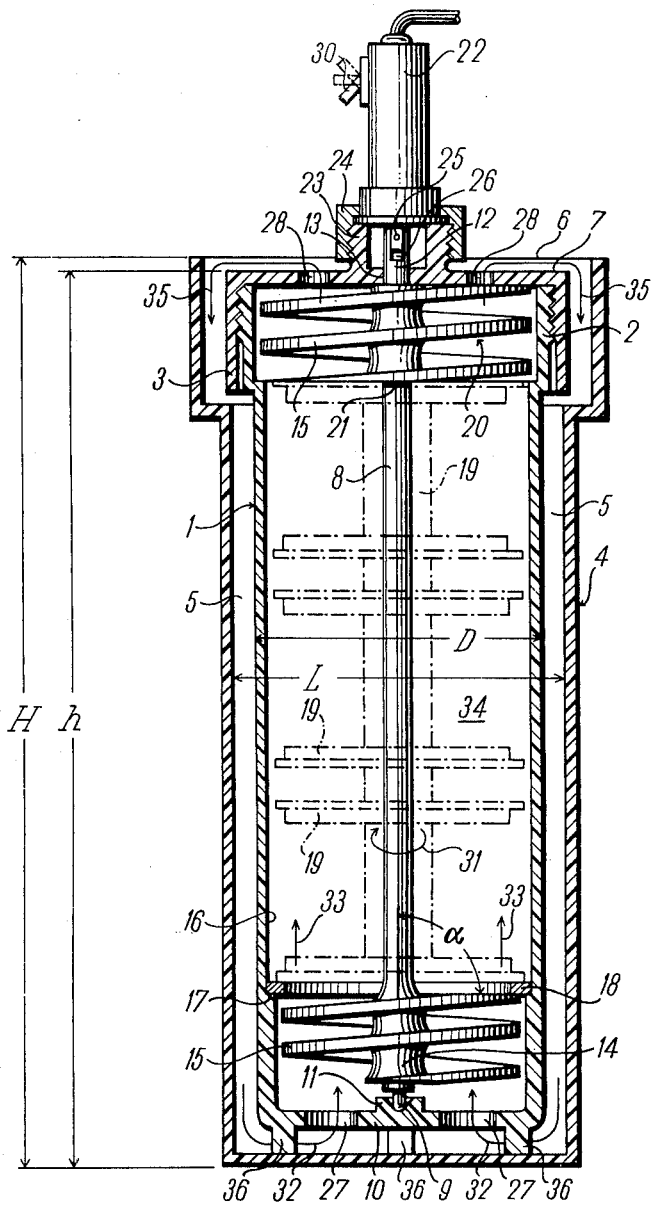
FIG. 1 is a vertical section through a container and vessel in accordance with the present invention.

The arrangement shown in FIG. 1 has a upwardly open cylindrical container or can 1 made of synthetic-resin material and having an upper threaded edge 2 over which a synthetic-resin cap 3 is screwed. The container 1 is received within a similarly cylindrical and upwardly open vessel 4 having an inner diameter L slightly greater than the outer diameter D of the cassette or container 1 so as to form a cylindrically annular passage 5 between these two. In addition the outer vessel 4 has a height H which is substantially greater than the height *h* of the can 1 so that its upper edge 6 extends above the upper surface 7 of the cap 3.

As also shown in FIG. 1 there is also provided within the can 1 a vertical rod 8 having a lower end 9 received in a journal 11 formed in the base 10 of the can 1 and having an upper end 12 passing through a central bore 13 formed through the cap 3. An auger 14 is rotatably fixed on the lower rod end 9 and has a double-thread 15 with a pitch angle $\alpha$ of greater than 75°, here 85°. Above this auger 14 there is formed in the inside wall 16 of the can 1 a shoulder 17 on which lies a metal stop ring 18 which prevents upward displacement of the auger 14 and serves as a buttom rest for a plurality of holders 19 formed with spiral grooves and adapted to receive strip-type film. Above these three holders 13 there is provided another auger 20 identical to the auger 14 but rotatable relative to the shaft 8 and resting on a shoulder 21 on this shaft 8.

A motor 22 secured by a nut 24 to a collar 23 on the cap 3 has a flat shaft 25 that can fit within a slot 26 in the upper end 12 of the rod. This motor may be energized in either direction in order to rotate the shaft 8 and auger 14. The cap 3 is similarly formed with holes 28 above the auger 15.

The device described above functions as follows:

The cap 3 with motor 22 are unscrewed from the can 1 and the auger 15 is lifted off the top end of the shaft 8. Then in a darkroom the film on the holders 19 is dropped over the shaft 8, the auger 15 is replaced on the upper end 12 and the cap 3 with the motor is screwed down tightly over the can 1. Once this cap is in place the filled container 1 can be brought out into a lighted room for further processing since the augers 14 and 15 are only slightly smaller in diameter than the corresponding ends of the can 1 so that no light can enter through the holes 27 and 28.

Fluid 29 (see FIG. 2) is then loaded into the vessel 4 and the switch 30 controlling the direction of the motor 22 is set so as to rotate the shaft 8 in the direction indicated by arrow 31. The can 1 is then lowered in the container 4 and the rotating auger 14 quickly draws the fluid up through the holes 27 as indicated by arrow 32. The liquid 29 rapidly rises in the chamber as indicated by arrows 33, past the film on the holders 19 to completely fill the interior 34 of the can 1.

Since the motor 22 can rotate the auger 14 at high speed the fluid will rapidly rise up past the auger 15, forcing this auger 15 to rotate, and will then flow out of the holes 28 in the direction indicated by arrows 35, back into the return chamber 5 formed between the cans 1 and 4. Continued rotation of the shaft 8 and auger 14 circulates the liquid in the direction of arrows 32, 33 and 35, with the feet 36 allowing the fluid to flow back in through the holes 27. Thus then even contacting of all the film in the holders 19 with the treatment liquid is ensured.

When the necessary treatment time has elapsed the switch 30 is actuated to reverse the motor 22 and the can 1 is lifted out of the vessel 4. The reverse rotating auger 14 in this case quickly pumps out the inside of the can 1 so that the user need not hold it above the vessel 4 and shake the device in order to drain it.

Figure 2:
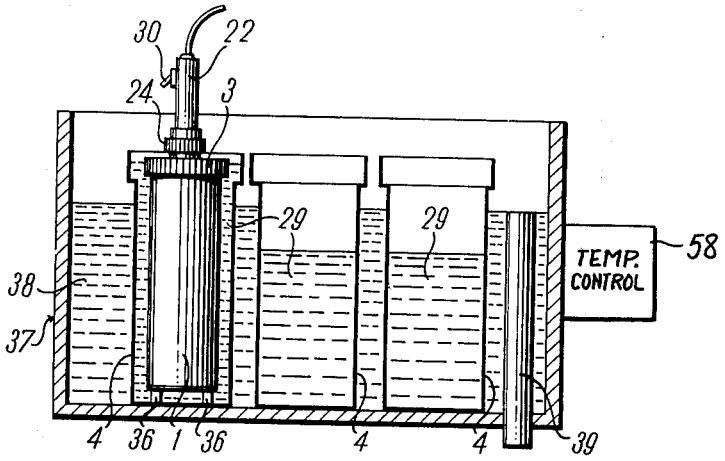
FIG. 2 is a vertical section through an apparatus according to this invention.

FIG. 2 shows how a large receptacle 37 that is filled with a bath 38 and that has an overflow conduit 39 that ensures a constant fluid level within the vessel 37 may contain three vessels 4. The temperature in the bath 38 is maintained constand by a controller 58 so that three different film-treatment liquids 29 are all maintained at the same temperature. The immersing and extracting steps described above may be repeated for each of the subsequent vessels 4. The filling and emptying time is nominal compared to the treatment time, and the circulation within the cans is very brisk so that extremely accurate and even results are obtained.

It is also noted that three cans 1 can be used and stepped sequentially through the precontainers 4 for maximum efficienty.

Figure 3:
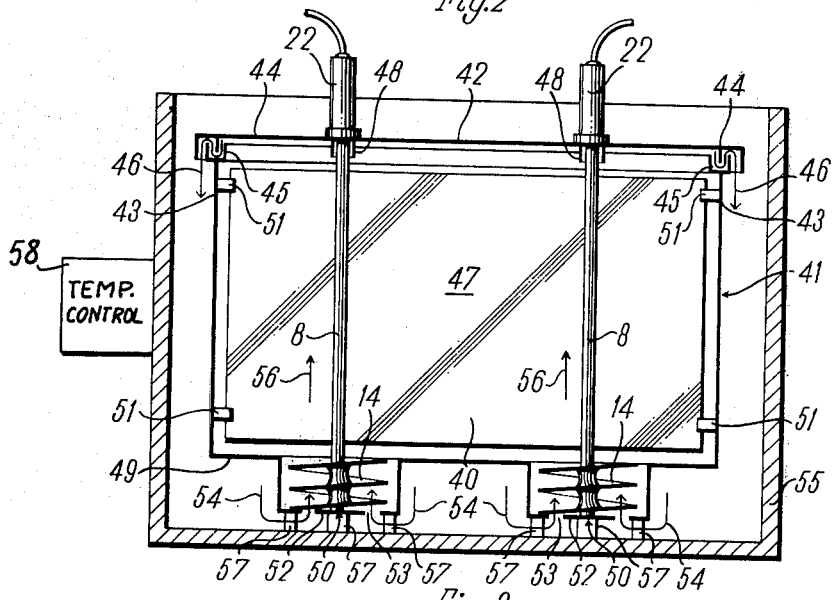
FIG. 3 is a vertical section through another arrangement in accordance with the present invention.

The arrangement in FIG. 3 serves to develop planar photographic plates 40, *x*-rays, or the like. This arrangement has a box-like upwardly open receptacle 41 closed by a rectangular cover 42. The upper edge 43 of the vessel 41 and the edge 44 of the cover 42 are both generally U-shaped so as to form interleaved baffles which form light gate allowing passage of liquid out of the vessel 41 through notches 45 as indicated by arrows 46. Two motors 22 as described above with shafts 8 are secured to the cover 42 with sleeves 48 similarly preventing light entry into the interior 47 of the container 41.

The base 49 of this vessel 41 has two cylindrical wells 50 each of which receives a respective auger 14 carried on the lower end 9 of a respective shaft 8. The height of these wells 50 is such that the augers 14 are completely recesses in them so that the photographic plates 40 secured in holders 51 can take up the entire interior 47. Holes 53 in the bottom 52 of the wells 50 allow fluid to enter between feet 57 formed on these wells as indicated by arrows 54. The entire container 41 is adapted to be received with a receptacle 55 corresponding in function to the container 4.

With this arrangement the liquid in the outer container 55 can be pumped upwardly through the interior 47 of the container 41 by the augers 14 as indicated by arrows 56. The liquid will enter as shown by arrows 54 and leave as shown by arrows 46 in a manner similar to that described above.

Means 58 may also be provided on this container 55 to maintain the liquid therein at a constant temperature. This arrangement 58 can comprise a cooler or heater depending on the desired temperature and ambient temperature.

I claim:

1. An apparatus for developing photographic film, said apparatus comprising:

an outer vessel for holding a bath of film-treatment liquid;

a container receivable within said vessel and having a base and a removable cap each formed with at least one throughgoing hole for passage through said container of said liquid;

means in said container for holding said film between said base and said cap;

a rotatable shaft extending in said container from said base to said cap;

an auger secured to said shaft adjacent said base and having a pitch greater than 45°, whereby rotation of said shaft and auger displaces said liquid in said container; and means for preventing light from entering said container through said holes and falling on said film.

2. The apparatus defined in claim 1 wherein said container is provided on said base with downwardly extending feet and is adapted to stand in said vessel on said feet.

3. The apparatus defined in claim 1 wherein said means for preventing is in part constituted by a double screw thread and said auger closely overlies said hole in said base.

4. The apparatus defined in claim 1 wherein said means for preventing is in part constituted by a second auger closely juxtaposed with said cap at said hole in said cap.

5. The apparatus defined in claim 4 wherein said holder and said second auger are carried on said shaft.

6. The apparatus defined in claim 5 wherein said shaft has an upper end passing upwardly through said cap, said apparatus further comprising a motor carried on said cap and couplable to said upper end for rotationally driving said shaft and the first-mentioned auger.

7. The apparatus defined in claim 1 wherein said container and said vessel are both substantially cylindrical and said cap is screwed onto said container.

8. The apparatus defined in claim 1 wherein said vessel is sufficiently deep to immerse said container in said liquid.

9. The apparatus defined in claim 1, further comprising a reservoir dimensioned to hold several such vessels.

10. The apparatus defined in claim 1 wherein said container is of rectangular cross-section and said base is formed at said hole with a downwardly extending well receiving said auger.

11. The apparatus defined in claim 10, further comprising a second such shaft, auger, and well therefore in said base of said container.

12. The apparatus defined in claim 11 wherein said container is upwardly open, said cap fits over said container, and said means for preventing is in part constituted as an interleaved plurality of baffles carried on the upper edge of said container and on said cover.

* * * * *